United States Patent [19]

Wick

[11] 4,351,279

[45] Sep. 28, 1982

[54] AIR VANE GOVERNOR FOR INTERNAL COMBUSTION ENGINE

[75] Inventor: Gerald H. Wick, Galesburg, Ill.

[73] Assignee: Outboard Marine Corporation, Waukegan, Ill.

[21] Appl. No.: 157,305

[22] Filed: Jun. 9, 1980

[51] Int. Cl.[3] ..... F02D 11/02

[52] U.S. Cl. ..... 123/391; 123/392

[58] Field of Search ..... 123/392, 391, 378, 376, 123/403, 337, 398, 198 D, 198 DB; 56/10.2

[56] References Cited

U.S. PATENT DOCUMENTS

| | | | |
|---|---|---|---|
| 2,836,159 | 5/1958 | Morden | 123/392 |
| 3,104,657 | 9/1963 | Rice | 123/392 |
| 3,161,186 | 12/1964 | Reichenbach et al. | 123/392 |
| 3,640,253 | 2/1972 | Glover et al. | 123/392 |
| 3,650,252 | 3/1972 | Glover et al. | 123/392 |
| 4,108,120 | 8/1978 | Woelffer | 123/391 |
| 4,220,124 | 9/1980 | Morris et al. | 123/391 |

FOREIGN PATENT DOCUMENTS

| | | | |
|---|---|---|---|
| 2318305 | 2/1977 | France | 123/391 |
| 1374187 | 11/1974 | United Kingdom | 123/391 |

*Primary Examiner*—Raymond A. Nelli

*Attorney, Agent, or Firm*—Michael, Best & Friedrich

[57] ABSTRACT

The internal combustion engine for a lawn mower or the like includes a carburetor, a throttle member or plate disposed in the carburetor throat and movable between an open position and a flow restricting position, a rotatable shaft carrying the throttle plate and connected to a movable air vane, an engine fan, such as a finned flywheel, for blowing air against the air vane and urging the throttle plate toward a flow restricting position, a torsion spring encircling the throttle shaft with a first end connected thereto for biasing the throttle plate toward the open position and adjustment means connected to the spring for adjusting the biasing force of the spring on the throttle plate. The adjustment means includes a speed control member or lever connected to the second end of the spring and mounted remotely from the throttle shaft for reciprocative movement in a direction transversely of the rotational axis of the throttle shaft between first and second spring force level positions. The adjustment means also includes a collar surrounding the throttle shaft and connected to the first end of the spring and interlocking means on the air vane and on the collar for effecting common rotation of the air vane and collar and for releasably permitting rotation of the collar relative to the air vane for adjusting the biasing force of the spring on the throttle plate.

9 Claims, 4 Drawing Figures

AIR VANE GOVERNOR FOR INTERNAL COMBUSTION ENGINE

BACKGROUND OF THE INVENTION

This invention relates to air vane governors for internal combustion engines and, in one aspect, to lawn mowers powered by an internal combustion engine including an air vane governor.

Air vane governors can be used on small internal combustion engines. This type of governor includes an air vane which is located adjacent an engine blower and is connected to the engine throttle plate which is biased toward the open position by a spring. As the engine tends to speed up under little or no load, the increased force of the air blowing against the air vane moves the throttle plate against the biasing force and toward the closed position and the engine slows down. On the other hand, as the engine speed slows down because of increased load, the reduced force of the air blowing against the air vane permits the spring to move the throttle plate toward the open position and the engine speed remains relatively constant at a pre-selected level.

Means for conveniently and rapidly adjusting the carburetor to obtain a pre-selected engine speed during initial assembly is desirable. Also, the capability of varying the governed speed during operation is often desirable. For instance, for internal combustion engines used on powered lawn mowers, it may be desirable to run the engine at a higher than usual speed for a short time, such as when cutting exceptionally heavy grass.

Examples of prior art constructions for air vane governors are disclosed in the following United States patents:

| Patentee | U.S. Pat. No. | Issue Date |
|---|---|---|
| Jackson | 2,525,602 | Oct. 10, 1950 |
| Hall | 2,815,739 | Dec. 10, 1957 |
| Rice | 3,104,657 | Sept. 24, 1963 |
| Reichenbach et al | 3,161,186 | Dec. 15, 1960 |
| Glover et al | 3,640,253 | Feb. 8,1972 |
| Glover et al | 3,650,252 | Mar. 21, 1972 |

Attention is also directed to U.S. Pat. applications Ser. No. 915,662, filed June 15, 1978 now U.S. Pat. No. 4,221,202, and Ser. No. 915,764, filed June 15, 1978, now U.S. Pat. No. 4,220,124, both assigned to the assignee of the present application.

SUMMARY OF THE INVENTION

The invention provides an internal combustion engine including a carburetor having a throat, a pivotal throttle member disposed in the throat and pivotable between an open position and a fluid flow restricting position, a movable air vane, a rotatable shaft carrying the throttle member and connected to the air vane for moving the throttle member in response to movement of the air vane, means for impelling air against the air vane to move the air vane and urge the throttle member toward a flow restricting position in response to engine rotation, a torsion spring encircling the shaft and connected thereto for biasing the throttle member toward the open position, and adjustment means connected to the spring for adjusting the biasing force of the spring on the throttle member.

In one embodiment, the adjustment means includes a control member connected to one end of the spring and mounted remotely from the throttle shaft for reciprocative movement in a direction transversely of the rotational axis of the throttle shaft between a first spring force level position and a second spring force level position.

In another embodiment, the adjustment means includes a collar surrounding the throttle shaft and connected to one end of the spring and interlocking means on the air vane and on the collar for effecting common rotation of the air vane and the collar and for releasably permitting rotation of the collar relative to the air vane for adjusting the biasing force of the spring on the throttle member.

One of the principal features of the invention is the provision of an internal combustion engine having an air vane governor which includes a torsion spring biasing the engine throttle member toward the open position and adjustment means for conveniently adjusting the biasing force of the spring so as to adjust the engine speed.

Another of the principal features of the invention is the provision of such an internal combustion engine wherein the adjustment means includes a control member connected to one end of the spring and mounted remotely from a shaft carrying the engine throttle member for moving the spring between first and second force levels.

A further of the principal features of the invention is the provision of such an internal combustion engine wherein the adjustment means includes a collar surrounding the throttle shaft and connected to one end of the spring for adjusting the biasing force of the spring on the engine throttle member.

Other features, aspects and advantages of the invention will become apparent upon reviewing the following description, the drawing and the appended claims.

Before explaining at least one embodiment of the invention in detail, it is to be understood that the invention is not limited in its application to the details of the construction and arrangement of parts set forth in the following general description or illustrated in the accompanying drawings, since the invention is capable of other embodiments and of being practiced or carried out in various ways. Also, it is to be understood that the phraseology or terminology employed herein is for the purpose of description and not of limitation.

GENERAL DESCRIPTION

Figure 1:
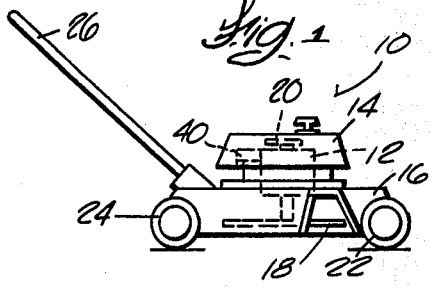
FIG. 1 is a perspective view of a lawn mower embodying various of the features of the invention.

Illustrated in FIG. 1 is a lawn mower 10 including an internal combustion engine 12 partially covered by a shroud 14 and supported on a frame including a blade housing 16. The engine 12 drives a cutter blade 18 located inside the blade housing 16 and includes a rotary cooling fan, such as a finned flywheel 20. The lawn mover 10 is supported for travel along the ground by front and rear wheels 22 and 24 and includes a handle 26 for guiding the mower.

Figure 2:
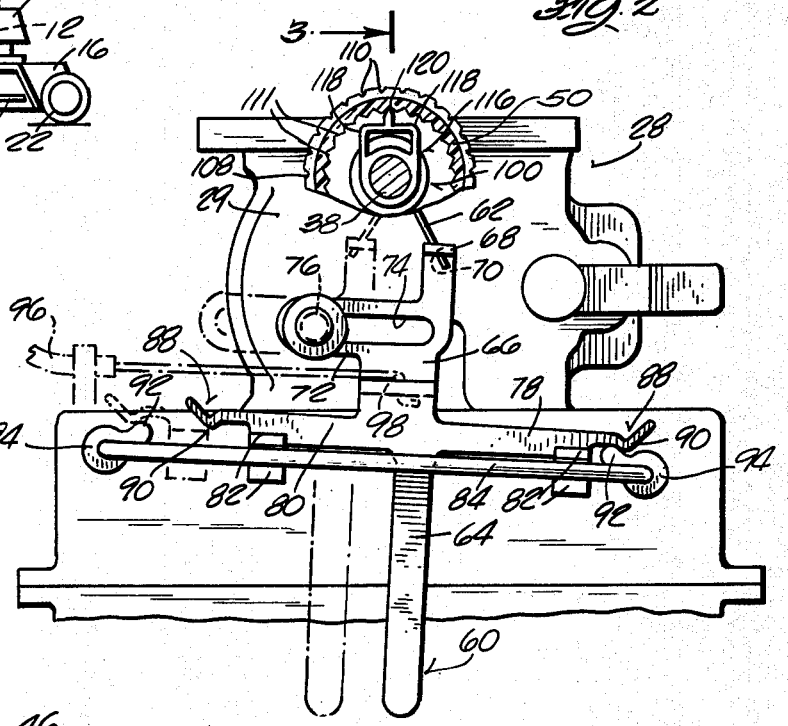
FIG. 2 is an enlarged, fragmentary top plan view of the carburetor and air vane governor incorporated in the internal combustion engine of the lawn mower shown in FIG. 1.
Figure 3:
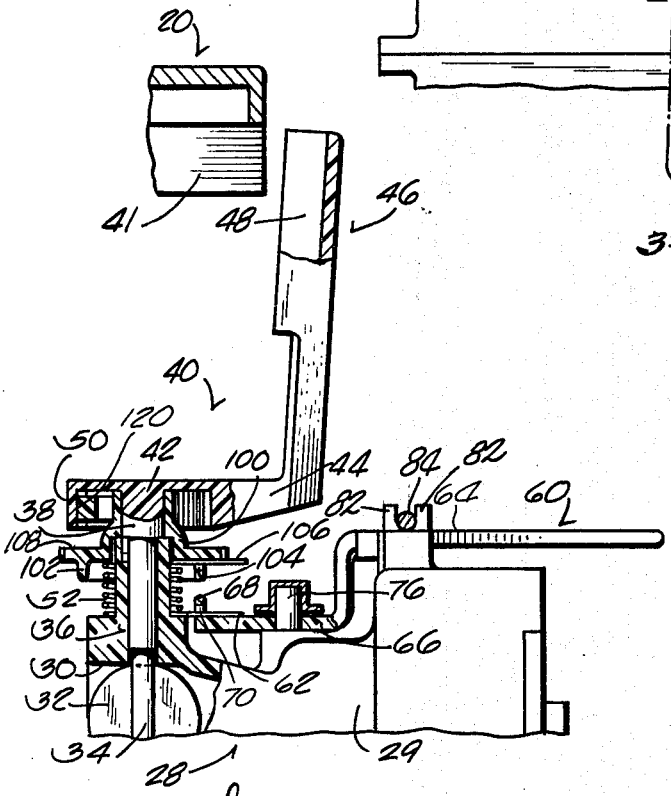
FIG. 3 is a sectional view taken generally along line 3—3 in FIG. 2.
Figure 4:
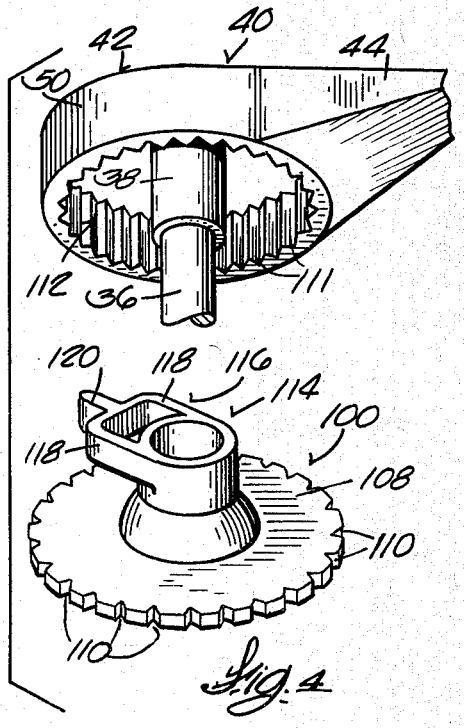
FIG. 4 is an enlarged exploded perspective view, partially fragmentary, of the air vane and the adjustment collar of the air vane governor.

Referring to FIGS. 2 and 3, the engine 12 includes a carburetor 28 having a body 29 defining a throat 30 through which a fuel-air mixture flows in the usual manner. Engine speed is governed by a butterfly-type, throttle member or plate 32 disposed in the carburetor throat 30 and pivotable between an open position extending generally parallel to the direction of flow (i.e., parallel to the longitudinal axis of the throat 30) and a fluid flow restricting position extending generally transversely of the direction of flow. The throttle plate 32 is carried on the inner end 34 of a rotatable shaft 36 which extends through the carburetor body 29 generally perpendicular to the longitudinal axis of the throat 30 and has an outer end 38 located exteriorly of the carburetor body 29.

Connected to the outer end 38 of the shaft 36 for controlling the position of the throttle plate 32 during engine operation is an air vane 40 which is located in close proximity to the periphery of the engine flywheel 20. The engine flywheel 20 includes a plurality of radially extending, circumferentially spaced fins or impeller blades 41 (one shown) which impel or blow air against the air vane 40. The force applied on the air vane 40 by this air flow is related to the rotational speed of the flywheel 20, and thus to engine speed.

More specifically, the air vane 40 includes a generally circular body 42 fixedly connected to the outer end 38 of the shaft 36 and an arm 44 which extends radially from the body 42. The arm 44 carries an axially extending, generally rectangular curved blade 46 which has a concave surface 48 facing the periphery of the engine flywheel 20. The blade 46 is located so that the air impelled against the concave surface 48 by the impeller blades 42 creates a torque on the shaft 36 urging the throttle plate 32 toward a flow restricting position. This torque increases with an increase in engine speed and decreases with a decrease in engine speed. The air vane 40 also includes an annular wall 50 extending axially from the body 42 toward the carburetor body 29.

The torque applied on the shaft 36 by the air van 40 is balanced by a torsion spring 52 encircling the shaft 36 and having one end acting on the shaft 36 to bias the throttle member 32 toward the open position. Thus, as the force of the air flow impelled against the blade 46 increases with increased engine speed, the torque applied on the shaft 36 by the air vane 40 overcomes the biasing force of the spring 52 and pivots the throttle plate 32 toward a flow restricting position to reduce engine speed.

In the event engine speed decreases due to an increased load, such as the cutter blade 18 encountering heavy grass, the rotational speed of the engine flywheel 20 decreases. As the air force impelled against the blade 46 decreases due to reduced engine speed, the closing torque applied on the shaft 36 by the air vane 40 decreases and the spring 52 tends to urge the throttle plate 32 toward an open position to permit an increased flow of the fuel-air mixture through the carburetor throat 30 with a resultant increase in engine speed. Thus, the combined effect of the air vane 40, the finned engine flywheel 20, and the spring 52 tends to cause the engine to operate at a pre-selected speed, irrespective of the load on the engine. This pre-selected engine speed is governed primarily by the rotational tension or biasing force of the spring 52 on the throttle plate 32.

Adjustment means are provided for adjusting the biasing force of the spring 52 on the throttle plate 32. Such means includes a speed control member or lever 60 connected to one end 62 of the spring 52 and slidably mounted on the carburetor body 29 remotely from the shaft 36 for reciprocative movement in a direction transversely of the rotational axis of the shaft 36. The speed control lever 60 is movable between a high speed position wherein the biasing force of the spring 52 urging the throttle plate 32 toward the open position is increased and a low speed position wherein the opening biasing force of the spring 52 is decreased. Thus, the high and low speed positions of the speed control lever 60 can be referred to as the first and second spring force level positions.

When the speed control lever 60 is in the high speed position, a high air force on the blade 46, and thus a high engine speed, is required to overcome the opening biasing force of the spring 52 and move the throttle plate 32 toward a flow restricting position. On the other hand, the throttle plate 32 is moved toward a flow restricting position at a lower engine speed when the speed control lever 60 is in the low speed position.

In the specific construction illustrated, the speed control lever 60 includes an elongated arm 64 having an offset inner end position 66 terminating in an outturned flange 68 including an aperture 70 in which the end 62 of the spring 52 is anchored. The speed control lever 60 also includes a leg 72 extending from the inner end portion 66 of the arm 64 and having a guideway or slot 74 which slidably receives a guide pin 76 on the carburetor body 29. The speed control lever 60 further includes a pair of extensions 78 and 80 projecting laterally from the opposite edges of the arm 64. Each of the extensions 78 and 80 has a pair of spaced ears 82 slidably receiving a retainer bar 84 mounted on the carburetor body 29.

Linear movement of the speed control lever 60 between the high speed position illustrated by the solid lines in FIG. 2 and the low speed position illustrated by the dashed lines in FIG. 2 is guided by the cooperation of the slot 74, the guide pin 76, the ears 82 and the retainer bar 84. An operator can make the desired speed adjustment by grasping the outer end of the speed control lever 60 and manually sliding it back and forth.

Means can be provided for releasably retaining speed control lever 60 in the high and low speed positions. While various arrangements can be used, in the particular construction illustrated, such means (FIG. 2) comprises the provision of a detent section 88 on the outer end of each extension 78 and 80. Each detent section 88 is resilient and has a cam or lobe 90 which rides over and seats against an arcuate node portion 92 of a boss 94 mounted on the carburetor body 29.

If desired, the speed control lever 60 can be moved to positions intermediate the high and low speed positions and detent means provided for each intermediate speed position. Also, the speed control lever 60 can be operated from a remote location by providing a conventional bowden cable 96 and connecting same at 98 to the arm 64 as illustrated by dashed lines in FIG. 2.

The speed adjustment means also includes an adjustment collar 100 rotatably carried on the shaft 36. The adjustment collar 100 has a cylindrical portion 102 surrounding the spring 52 and including an aperture 104 in which the other end 106 of the spring 52 is anchored. The adjustment collar 100 also includes a radially extending, circular flange 108 having a plurality of circumferentially spaced serrations 110 to facilitate gripping. The flange 108 serves as a knob for rotating the adjustment collar 100 relative to the shaft 36 for setting the rotational tension or opening biasing force of the spring 52 on the throttle plate 32 to a pre-selected level during initial assembly. As viewed in FIG. 2, counterclockwise rotation of the adjustment collar 100 relative to the shaft 36 decreases the opening biasing force and reduces the pre-selected engine speed while clockwise rotation of the adjustment collar 100 relative to the shaft 36 increases the biasing force and increases the pre-selected engine speed.

Means are provided for releasably interlocking the adjustment collar 100 and the air vane 40 to effect common rotation during normal operation and to permit rotation of the adjustment collar 100 relative to the air vane 40 to facilitate the presetting of the engine speed described in the preceding paragraph. While various arrangements can be used, in a specific construction illustrated, such interlocking means includes a plurality of circumferentially spaced indentations or serrations 111 on the inner surface 112 of the air vane wall 50 and a detent element 114 on the adjustment collar 100 adapted to releasably engage the serrations 110.

More specifically, the detent element 114 comprises a spring element 116 including a pair of bowed, flexible legs 118 and an indexing projection 120 which is urged into releasable engagement with the serrations 110 by the resilient character of the legs 118. The engine speed can be pre-set by holding the air vane 40, grasping the adjustment flange 108, and rotating the adjustment collar 100 either clockwise or counterclockwise. The legs 118 of the spring element 116 flex to permit the indexing projection 120 to "ratchet" over the serrations 110, thereby permitting rotation of the adjustment collar 100 relative to the air vane 40 to obtain the pre-set engine speed.

To simplify fabrication and assembly, the blade 46, the arm 44, the air vane body 42, the wall 50, and the shaft 36 preferably are molded as a one-piece unit from a synthetic plastic material and the shaft 36 is provided with a longitudinal slot for receiving the throttle plate 32. Also, the adjustment collar 100, including the spring element 116, preferably is molded as a one-piece unit from the synthetic plastic material. In both cases, various components can consist of discrete parts which are joined together in a suitable manner.

Various of the elements of the invention are set forth in the following claims:

I claim:

1. An internal combustion engine comprising a carburetor having a throat, a pivotal throttle member disposed in said throat and pivotable between an open position and a fluid flow restricting position, a movable air vane including a body comprising an annular wall extending axially from said body and having an inner surface, a rotatable shaft carrying said throttle member and connected to said air vane for moving said throttle member in response to movement of said air vane, means for impelling air against said air vane to move said air vane and urge said throttle member toward a flow restricting position in response to engine rotation, a torsion spring encircling said shaft, having a first end connected to said shaft for biasing said throttle member toward the open position, and having a second end, and adjustment means connected to said spring for adjusting the biasing force of said spring on said throttle member, said adjustment means including a control member connected to said second end of said spring and mounted remotely from said shaft for movement which is solely reciprocatory in a direction transversely of the rotational axis of said shaft between a first spring force level position and a second spring force level position, a collar surrounding said shaft and connected to said first end of said spring, and interlocking means on said air vane and on said collar for effecting common rotation of said air vane and said collar and for releasably permitting rotation of said collar relative to said air vane so as to adjust the biasing force of said spring on said throttle member, said interlocking means including a plurality of circumferentially spaced indentations on said inner surface of said wall, a detent element on said collar for lockingly engaging said indentations, and biasing means for biasing said detent element into releasable locking engagement with said indentations.

2. An internal combustion engine according to claim 1 wherein said control member is movable to a range of positions between said first and second spring force level positions.

3. An internal combustion engine according to claim 1 including detent means for releasably retaining said control member in said first and second spring force level positions, said detent means including means located stationarily and means on said control member engagable with said stationarily located means.

4. An internal combustion engine according to claim 1 wherein said control member is slidably mounted on said carburetor for linear movement.

5. An internal combustion engine according to claim 1 wherein said detent element and said biasing means comprises a spring member on said collar including a projection serving as said detent element.

6. An internal combustion engine according to claim 5 wherein said spring member and said collar is a one-piece unit.

7. An internal combustion engine comprising a carburetor having a throat, a pivotal throttle member disposed in said throat and pivotable between an open position, and a fluid flow restricting position, a movable air vane including a body comprising an annular wall extending axially from said body and having an inner surface, a rotatable shaft carrying said throttle member and connected to said body of said air vane for moving said throttle member in response to movement of said air vane, means for impelling air against said air vane to move said air vane and urge said throttle member toward a flow restricting position in response to engine rotation, and means for adjustably biasing said throttle member toward the open position and including a torsion spring encircling said shaft and having one end adapted to be fixed and a second end, a collar surrounding said shaft and connected to said second end of said spring, and interlocking means on said air vane and on said collar for effecting common rotation of said air vane and said collar and for releasably permitting rotation of said collar relative to said air vane so as to adjust the biasing force of said spring on said throttle member, said interlocking means including a plurality of circumferentially spaced indentations on said inner surface of said wall, a detent element on said collar for lockingly engaging said indentations, and biasing means for biasing said detent element into releasably locking engagement with said indentations.

8. An internal combustion engine according to claim 7 wherein said detent element and said biasing means comprises a spring member on said collar including a projection serving as said detent element.

9. An internal combustion engine according to claim 8 wherein said spring member and said collar is a one-piece unit.

* * * * *